US009908654B2

(12) United States Patent
Steinhoff et al.

(10) Patent No.: US 9,908,654 B2
(45) Date of Patent: Mar. 6, 2018

(54) APPARATUS FOR STORING, TRANSPORTING AND DISPENSING CONVEYOR BELTS

(71) Applicant: ASHWORTH BROS., INC., Fall River, MA (US)

(72) Inventors: Paul Steinhoff, Stephens City, VA (US); Joseph Allen Bowen, Gore, VA (US); Darroll Joseph Neely, Gerrardstown, WV (US)

(73) Assignee: ASHWORTH BROS., INC., Fall River, MA (US)

( * ) Notice: Subject to any disclaimer, the term of this patent is extended or adjusted under 35 U.S.C. 154(b) by 797 days.

(21) Appl. No.: 13/903,168

(22) Filed: May 28, 2013

(65) Prior Publication Data

US 2013/0255191 A1 Oct. 3, 2013

Related U.S. Application Data

(63) Continuation-in-part of application No. 12/913,594, filed on Oct. 27, 2010, now Pat. No. 8,469,191.

(51) Int. Cl.
*B65B 63/04* (2006.01)
*B65H 75/18* (2006.01)
(Continued)

(52) U.S. Cl.
CPC ..... *B65B 63/04* (2013.01); *B65D 19/385* (2013.01); *B65D 19/44* (2013.01); *B65D 85/672* (2013.01);
(Continued)

(58) Field of Classification Search
CPC ..... B65D 85/66; B65D 85/672; B65D 2519/00164; B65D 2519/00024;
(Continued)

(56) References Cited

U.S. PATENT DOCUMENTS 2,318,906 A * 5/1943 Troche ..... B65H 54/58 242/574.4
2,883,045 A * 4/1959 Abramson ..... B65D 85/672 206/396
(Continued)

FOREIGN PATENT DOCUMENTS

DE 101 27 120 A1 12/2002
JP 50-036981 4/1975
(Continued)

OTHER PUBLICATIONS

Korean Office Action for corresponding Korean Application No. 10-2013-7011678, dated May 29, 2015, with English translation, 16 pages.
(Continued)

*Primary Examiner* — Michael E Gallion
(74) *Attorney, Agent, or Firm* — Nixon Peabody LLP; Jeffrey L. Costellia

(57) ABSTRACT

An apparatus for storing, transporting and dispensing conveyor belts is described. The apparatus, in the form of a crate, has top and bottom conventional pallets, allowing for easy handling and strength for additional stacked crates. The center of the crate holds a hub assembly that moves rotationally, and allows smooth transition from consecutive layers of the conveyor belt wrapped thereon. During shipment, the roll of conveyor belt lies on its side. In one embodiment, a center pipe axle of the spool passes through holes in the top and bottom pallets. Alternatively, the center pipe axle passes through channels created between planks of the top and bottom pallets. These configurations secure the roll in the crate, and allow it to turn freely when loaded or unloaded.

20 Claims, 19 Drawing Sheets

(51) Int. Cl.
*B65D 19/38* (2006.01)
*B65D 19/44* (2006.01)
*B65D 85/672* (2006.01)

(52) U.S. Cl.
CPC ... *B65H 75/18* (2013.01); *B65D 2519/00024* (2013.01); *B65D 2519/00029* (2013.01); *B65D 2519/00034* (2013.01); *B65D 2519/00059* (2013.01); *B65D 2519/00064* (2013.01); *B65D 2519/00069* (2013.01); *B65D 2519/00094* (2013.01); *B65D 2519/00099* (2013.01); *B65D 2519/00104* (2013.01); *B65D 2519/00129* (2013.01); *B65D 2519/00134* (2013.01); *B65D 2519/00139* (2013.01); *B65D 2519/00164* (2013.01); *B65D 2519/00169* (2013.01); *B65D 2519/00174* (2013.01); *B65D 2519/00199* (2013.01); *B65D 2519/00203* (2013.01); *B65D 2519/00208* (2013.01); *B65D 2519/00233* (2013.01); *B65D 2519/00238* (2013.01); *B65D 2519/00243* (2013.01); *B65D 2519/00273* (2013.01); *B65D 2519/00293* (2013.01); *B65D 2519/00323* (2013.01); *B65D 2519/00333* (2013.01); *B65D 2519/00452* (2013.01); *B65D 2519/00497* (2013.01); *B65D 2519/00815* (2013.01)

(58) Field of Classification Search
CPC ..... B65D 19/385; B65D 19/44; B65B 63/04; B65H 75/18
See application file for complete search history.

(56) References Cited

U.S. PATENT DOCUMENTS 2,943,732 A * 7/1960 Kovaleski ..... B65D 85/04 206/303
3,184,053 A * 5/1965 Eldridge ..... B65D 85/672 242/118.61
3,858,723 A * 1/1975 Weiss ..... B65D 19/44 108/54.1
3,874,607 A * 4/1975 Hornig ..... B27L 5/00 156/433
4,113,092 A * 9/1978 Williams ..... B65B 55/00 206/408
4,248,414 A * 2/1981 Rovin ..... B65H 45/04 242/532.6
4,513,864 A * 4/1985 Liebel ..... B65D 85/672 206/303
4,862,636 A * 9/1989 Doskocil ..... A01K 91/18 242/402
4,995,512 A * 2/1991 Liebel ..... B65D 85/671 206/396
5,097,951 A * 3/1992 Pigott ..... B65D 19/44 108/55.3
5,228,821 A * 7/1993 Gleffe ..... B65D 19/12 108/53.1
5,533,620 A * 7/1996 Torterolo ..... B65D 85/672 206/396
5,579,918 A 12/1996 McCurry
5,660,277 A * 8/1997 Bostic ..... B65D 85/66 206/397
5,704,479 A * 1/1998 Barnett ..... B65H 49/322 206/395
6,286,677 B1 * 9/2001 Gabrio ..... B65D 85/672 206/413
6,315,122 B1 * 11/2001 McCord ..... B65D 19/38 206/408
6,352,216 B1 * 3/2002 Coats ..... B65H 75/22 242/608.4
6,663,041 B2 12/2003 Buschulte et al.
8,225,929 B1 * 7/2012 Penkaty ..... B65D 81/053 206/398
8,469,191 B2 * 6/2013 Steinhoff ..... B65D 19/385 206/386
2002/0059782 A1 * 5/2002 Kadota ..... B65D 85/66 53/442
2002/0171003 A1 * 11/2002 Johnson ..... A47K 10/38 242/598.3
2003/0122017 A1 * 7/2003 Pariseau ..... B21C 47/143 242/361
2004/0118967 A1 * 6/2004 Rengifo ..... B65H 16/005 242/588.6
2009/0020045 A1 * 1/2009 Brunsmann ..... B65D 19/385 108/53.5
2009/0123695 A1 * 5/2009 Han ..... H05K 13/0084 428/134
2010/0001116 A1 * 1/2010 Johnson ..... H02G 11/02 242/588
2012/0103847 A1 5/2012 Steinhoff et al.
2012/0199683 A1 * 8/2012 Cox ..... B65H 75/22 242/118.62
2012/0286083 A1 * 11/2012 Iossa ..... B65H 49/32 242/403
2015/0016927 A1 * 1/2015 Troitzsch ..... B65H 67/0405 414/222.07

FOREIGN PATENT DOCUMENTS

JP 52-027923 2/1977
JP 53-100384 8/1978
JP H06 80315 A 3/1994
JP 2004-115081 4/2004
JP 2008-247596 10/2008
WO 2012/057899 A1 5/2012
WO WO 2014193848 A1 * 12/2014 ..... B65D 19/385

OTHER PUBLICATIONS

International Search Report and Written Opinion for International Application No. PCT/US2014/039606, dated Sep. 15, 2014.
International Search Report for International Application No. PCT/US2011/047261 dated Nov. 11, 2011.
Written Opinion for International Application No. PCT/US2011/047261 dated Nov. 11, 2011.

* cited by examiner

FIG. 11A
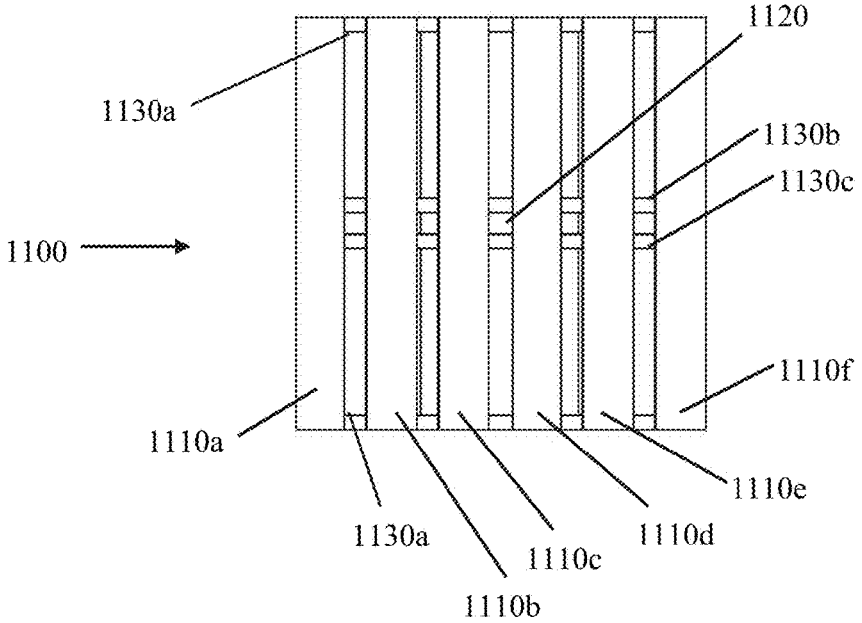
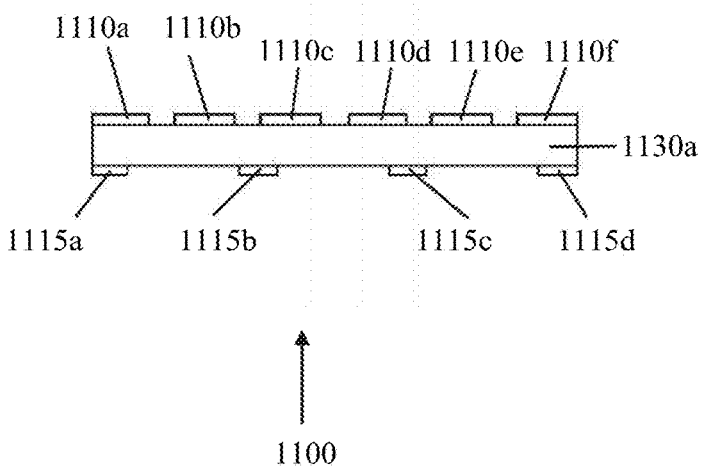
FIG. 11B

APPARATUS FOR STORING, TRANSPORTING AND DISPENSING CONVEYOR BELTS

BACKGROUND OF THE INVENTION

Field of the Invention

The present invention relates to a crating system, and in particular, to an apparatus for storing, transporting and delivering conveyor belts.

Description of Related Art

Conveyor belt systems are commonly used in various industrial fields for material handling and processing purposes. For instance, conveyor systems are used within food processing systems in which food items are placed on the support surface of a conveyor belt and processed, while being conveyed from one location to another. Various types of conveyor belts exist, including modular conveyor belts, which are especially popular in food processing systems. Moreover, conveyor systems are often used in a helical accumulator such as that disclose in U.S. Pat. No. 5,070,999 to Layne et al. which allows storage of a large number of items in the conveyor system.

Such conveyor belts are often very long, extending hundreds or even thousands of feet. To handle such voluminous belts in transit, storage and dispensation, crates of various sorts are used. Conventional crates are typically large, basic four-sided wooden boxes with fixed lengths and widths, as shown in FIG. 1A. In order to pack, for example, a self-stacking spiral belt into such a crate, the belt must be disassembled into short, flat sections, which are then stacked in the crate, such as in FIG. 1B and FIG. 1C. As shown in FIG. 1C, conventional crate system 100 comprised of housing 110 has disassembled belt sections 120*a-c* stacked therein, with side plates separating adjacent disassembled belt sections. For example, disassembled belt section 120*a* has side plates 125*a* and 125*b*, of which side plate 125*b* separates it from disassembled belt section 120*b*. Once the belt reaches its destination, it must be then reassembled and spliced between the separate sections. In food processing facilities with small passageways and sparse open area, for example, the large, voluminous crates are often disassembled elsewhere, and one section of belt at a time is transported to the point of installation.

In addition, because conveyor belts may vary in length and width, different sizes and multiple numbers of these conventional crates are needed to ship the belts. This requires that belt manufacturers keep a large quantity of crates on hand in many different sizes to accommodate orders for their various belt sizes. Thus, the storage of unused crates can occupy large portions of manufacturing space, adding to overhead and shipping costs that are eventually passed along to cost-conscious customers.

Other containers are known in which material can be transported in a roll, without disassembly into flat sections. For example, U.S. Pat. No. 3,184,053 to Eldridge discloses a combination shipping, storage and dispensing container for coiled material where the coil is mounted within the container, such that it is completely suspended without any of its sides or edges touching the inner sides of the container. The patent to Eldridge discloses a four-sided box blank with a fixed core member around which the stored material coils, and a pair of cup members at either end of the core member that are fixably attached to the container. However, this patent requires that a regular slotted carton be used, preferably made of corrugated box material. In addition, the horizontal suspension of material on the core member places stress on the container throughout shipping and storage process. Thus, the patent to Eldridge is limited as to the types and weights of materials that can be shipped and stored.

U.S. Pat. No. 6,315,122 to McCord et al. discloses a palletless packaging system having end plates with vertical channels that accommodate a core of rolled goods. However, the system is lightweight, recyclable and contains little to no wood. Further, the core of rolled goods must be lowered into the vertical channel. Thus, the patent to McCord et al. is only suitable for the packaging of light materials, such as fabric, thin film, or wiring. In addition, the loading and unloading of the core material by removal through the vertical channel is time and energy consuming, due to the additional space and tools needed to properly handle the material.

SUMMARY OF THE INVENTION

The above described crating systems propose a variety of mechanisms for moving, storing and dispensing roll goods. However, there still exists a need for a cost-effective, yet sturdy apparatus for storing, transporting and dispensing conveyor belts that maximizes the amount of belt being stored, while minimizing the space used to do so, particularly with respect to self-stacking spiral belts. There also exists a need for a crating apparatus that speeds installation time. Further, there exists an unfulfilled need for such a crating system that can be made to fit a variety of belt sizes.

In view of the foregoing, one aspect of the present invention provides an apparatus for storing, transporting and dispensing new and replacement conveyor belts that uses conventional top and bottom pallets. The use of conventional pallets in the apparatus provides for easy handling with a fork truck and the strength to allow multiple crates to be stacked. Furthermore, conventional pallets are inexpensive compared to custom-made crates that are not made or manufactured in large, cost-effective bulk quantities. Thus, the present invention has a standard shape that is easily loaded into a box trailer and maneuvered to the point of installation.

One advantage of the present invention is that it allows belts, and self-stacking spiral belts in particular, to wind about a spool. The spool allows for rotational movement, minimizing the amount of manual labor needed to install the belt. Further, the rotational movement allows the belt to self-dispense at a point of installation.

Another advantage of the present invention is that allows belts to be packed, shipped and dispensed in a continuous length. Because the joining of conveyor belts is a time-, energy- and expense-consuming process, it is desirable to use the longest possible conveyor belts to reduce the time and materials needed for rejoining the belt at the destination. An apparatus of the present invention meets that need by holding a continuous section of belt of up to fifty or more feet, requiring fewer welded splice joints to reassemble. This speeds packing, unpacking and installation of the belt at the destination.

A further advantage of the present invention is that it provides a cam-shaped hub which allows for free rolling and unrolling, and smooth transition between layers of rolled conveyor belts. In one embodiment, the cams are made with different offsets in order to accommodate different side plate heights of self-stacking spiral belts.

Still another advantage of the present invention is that the spool extends from the top pallet to the bottom pallet vertically, such that a roll of conveyor belt lies on its side during shipping and handling. Thus, both rotational movement during transportation and stress on the hub caused by the weight of the conveyor belt are reduced considerably.

A further advantage of the present invention is that it is smaller than conventional conveyor belt crating systems, allowing for easy loading into a box trailer and maneuverability to the point of installation. Further, the present invention takes up less space than conventional conveyor belt crating systems at points of installation, where there are typically small passageways and very little free space, such as at food processing facilities.

According to one embodiment, a conveyor belt crating system of the present invention comprises a housing having first and second pallets, the first and second pallet each comprising a pallet hole, a plurality of planks, and one or more channels created between adjacent planks, wherein the pallet hole of the first pallet is parallel to the pallet hole of the second pallet; a first and second drum hub positioned parallel to each other and between the first and second pallets, the first and second drum hubs each comprising a hub hole; and an axle engaging the hub holes of the first and second drum hubs and the pallet holes of the first and second pallets, thereby interconnecting the first and second pallets.

The first and second drum hubs may comprise at least two outer radii measurements equal to a minimum radius $r_{o1}$ and maximum radius $r_{o2}$. These outer radii measurements may increase gradually from the minimum radius $r_{o1}$ to the maximum radius $r_{o2}$. The first and second drum hubs may further comprise a step. The step can be of a length equal to the maximum radius $r_{o2}$ minus the minimum radius $r_{o1}$.

The first and second drum hubs may have a conveyor belt wound thereon. The conveyor belt may be a single, continuous piece of conveyor belt. The conveyor belt may be, for example, a self-stacking spiral conveyor belt. Two or more adjacent layers of the self-stacking spiral conveyor belt can be interconnected.

The housing of the conveyor belt crating system may further comprise a plurality of edge supports attached at distal ends to one or more corresponding edges of the first and second pallets. The housing may still further comprise one or more transverse crossbeams diagonally attached to an upper portion of one edge support and a lower portion of an adjacent edge support, and one or more of the transverse crossbeams can be removable. Alternative or additional to the edge supports and/or the transverse crossbeams, the housing may comprise one or more side panels attached to corresponding edges of the top and bottom pallets. Further, the edge supports may have one or more inner support beams mounted to an inner surface thereof. The top and bottom pallets can be conventional shipping pallets, and/or at least one of the one or more channels can be configured to receive tines of a fork truck. Further, the plurality of planks comprised in the top and bottom pallets can be positioned in two or more layers.

The axle of the conveyor belt crating system can be cylindrical in shape or have a cross-section that is square in shape. The axle may further comprise at least one of a notch, a hole, a key, a pin and a hook. The axle can extend through and beyond the pallet holes of the first and second pallets. Nevertheless, an outer surface of each of the first and second pallets can be flat. The pallet holes can be in at least one plank of the first and/or second pallets. Alternatively or additionally, the pallets holes can be in at least one of the one or more channels between adjacent planks of the first and/or second pallets.

According to one embodiment, a hub assembly for storing and transporting rolled material is described. The hub assembly comprises an axle and a first hub attached to said axle. A perimeter of the first hub comprises minimum and maximum radii and a step between the minimum and maximum radii.

Rolled material may be wound on the first hub. A width of the first hub can be equal to a width of the rolled material. A length of the step can be equal to a thickness of the rolled material.

A second hub can be attached to the axle. In one embodiment, a width of the first hub is less than a width of the rolled material, and a width of the second hub is less than a width of the rolled material. A perimeter of the second hub can comprise minimum and maximum radii and a step between the minimum and maximum radii. The first hub and the second hub can be positioned at opposite edges of the rolled material, and the step of the first hub and the step of the second hub can be aligned.

In one embodiment, the rolled material comprises a conveyor belt. The conveyor belt can comprise side plates. A length of the step can be equal to a thickness of the side plates.

The perimeter can be defined by a spiral shape formed by gradually increasing a radius of the first drum hub throughout one revolution about a common center point, and a length of the step can be equal to a difference between the maximum and minimum radii. The perimeter can comprise a first smaller radius with a first center point and at least one successively larger radius with a center point distinct from the first center point, and each successive radius can be tangential to the previous radius throughout one revolution, such that the step is created between a beginning of the first smaller radius and an end of a final larger radius.

A method of storing and transporting rolled material according to one embodiment is also described. The method comprises abutting an end of the rolled material against a step defined by a difference between maximum and minimum radii of a hub, and wrapping a continuous length of the rolled material around a perimeter of the hub, wherein the hub is attached to an axle.

The axle can be placed in a horizontal orientation when wrapping the continuous length of the rolled material around the perimeter of the hub. The ends of the axle can be constrained inside a crate. The axle can be allowed to rotate freely. The rolled material can be placed on a pallet with the axle in a vertical orientation. The rolled material can comprise a conveyor belt.

Still other aspects, features and advantages of the present invention are readily apparent from the following detailed description, simply by illustrating a number of exemplary embodiments and implementations, including the best mode contemplated for carrying out the present invention. The present invention also is capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

FIG. 11A is an interior view of an end pallet for use in the crating system of, for example, FIG. 10, in accordance with an implementation of the present invention.

FIG. 11B is a side view of the end pallet shown in FIG. 11A.

DETAILED DESCRIPTION

An apparatus for storing, transporting and dispensing conveyor belts is described. In the following description, for purposes of explanation, numerous specific details are set forth in order to provide a thorough understanding of the exemplary embodiments. It is apparent to one skilled in the art, however, that the present invention can be practiced without these specific details or with an equivalent arrangement.

Figure 1A:
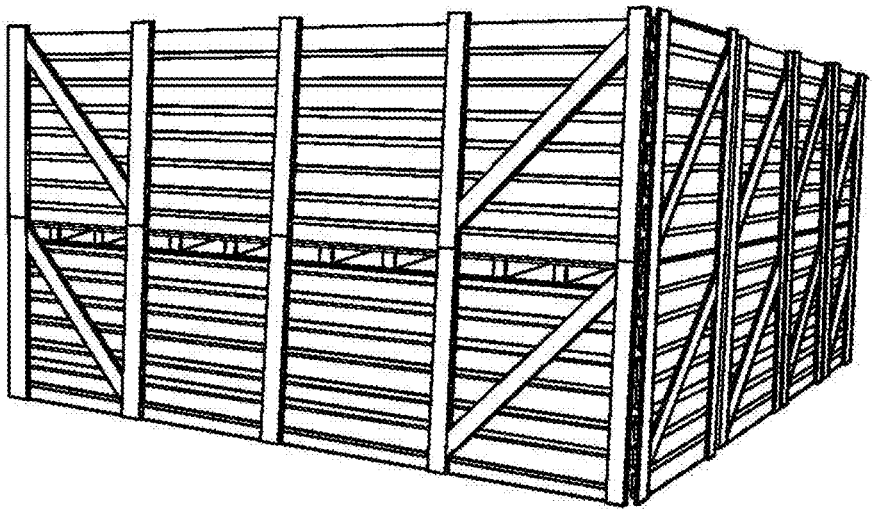
FIG. 1A shows stacked conventional crates for storing and transporting conveyor belts.
Figure 1B:
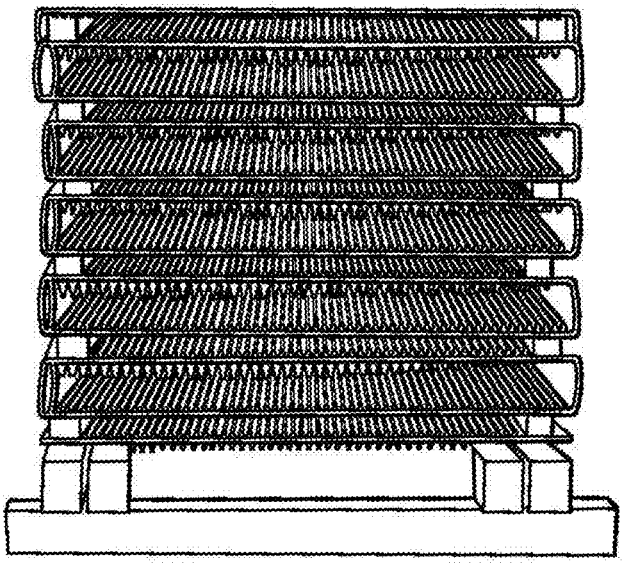
FIG. 1B shows an open conventional crate for storing and transporting self-stacking spiral conveyor belts, with disassembled sections of the belt stacked therein.
Figure 1C:
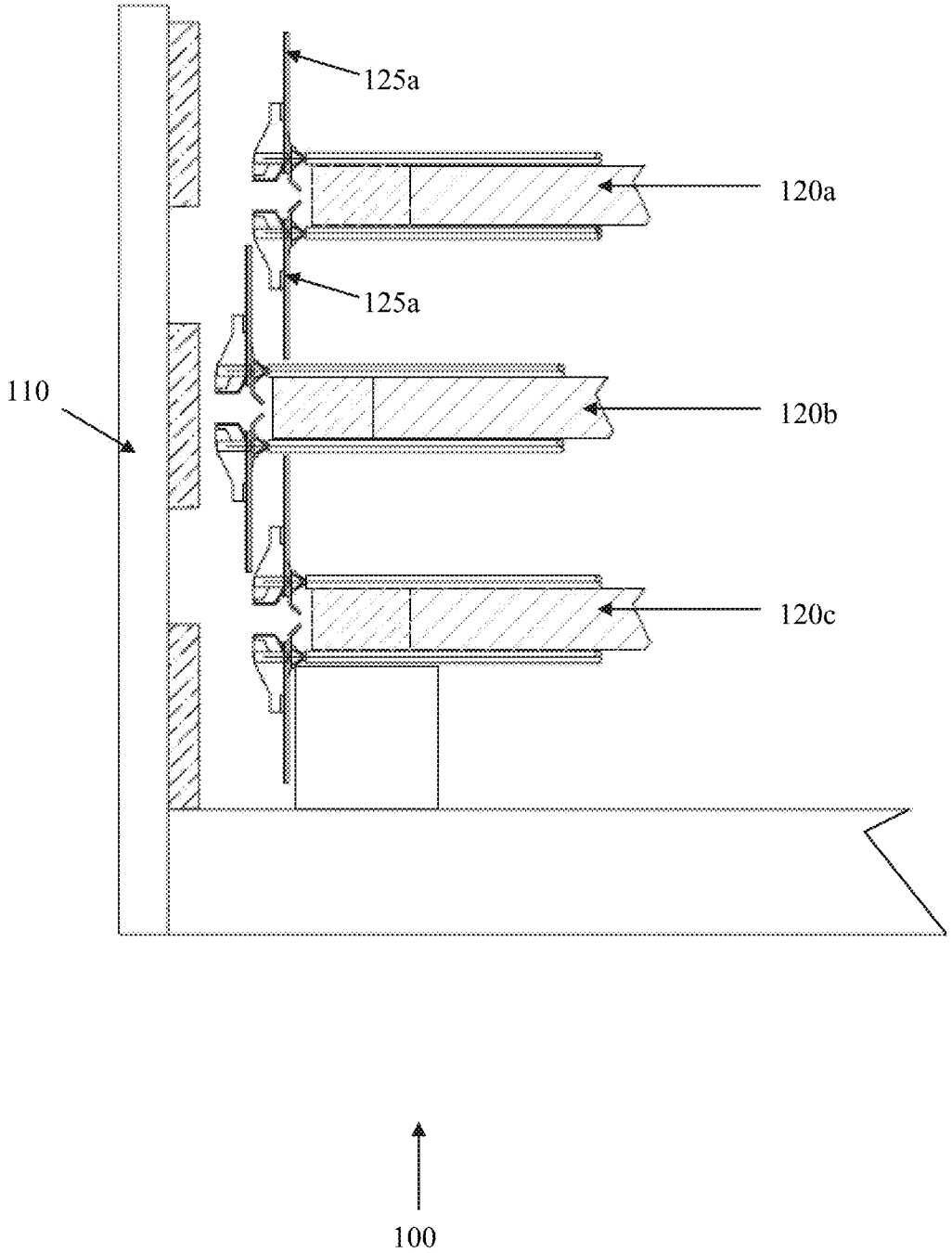
FIG. 1C shows a partial cross-section of a conventional crate for storing and transporting self-stacking spiral conveyor belts, with disassembled sections of the belt stacked therein.
Figure 2:
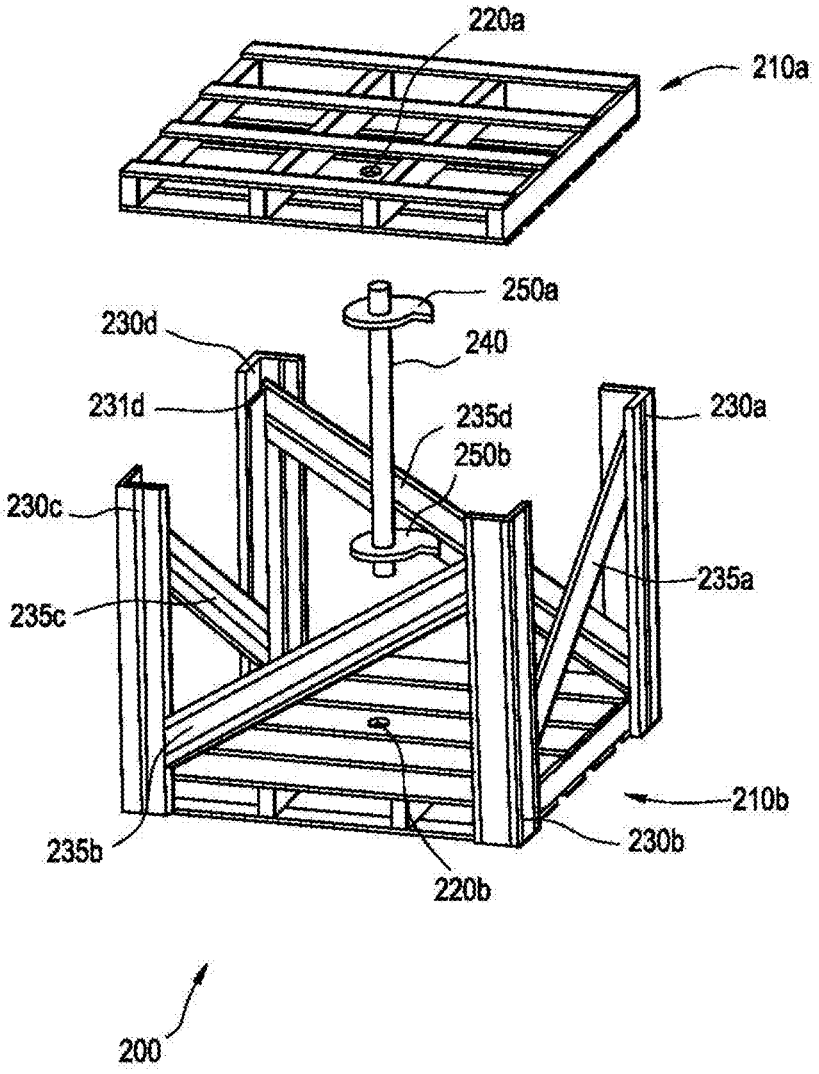
FIG. 2 is a perspective view of a disassembled crating system for storing, transporting and dispensing conveyor belts in accordance with one implementation of the present invention.

Referring now to the drawings, wherein like reference numerals designate identical or corresponding parts throughout the several views, FIG. 2 is a perspective view of a disassembled crating system 200 for storing, transporting and dispensing conveyor belts, in accordance with one implementation of the present invention. Crating system has top and bottom pallets 210*a* and 210*b*, which are conventional pallets, as recognized by one skilled in the art, and as described further herein. Top and bottom pallets 210*a* and 210*b* have pallet holes 220*a* and 220*b*, respectively, located centrally thereon, that are configured to receive distal ends of a hub assembly comprising axle 240 and drum hubs 250*a* and 250*b*. Pallet holes 220*a* and 220*b* can be made in top and bottom pallets 210*a* and 210*b* using a tool, such as, for example, a hole saw.

Top and bottom pallets 210*a* and 210*b* are connected to each other at their corresponding edges via edge supports 230*a-d*, each of approximately the same height. Edge supports 230*a-d* can be made from any sturdy material, such as, for example, wood, metal, and/or plastic, and function to support top and bottom pallets 210*a* and 210*b*, particularly when crating system 200 is stacked. In this embodiment, edge supports 230*a-d* are constructed of two wooden planks joined along their lengths that wrap around corresponding outer corners of top and bottom pallets 210*a* and 210*b*.

Edge supports 230*a-d* may further have an inner support beam, as illustrated by reference numeral 231*d* with respect to edge support 230*d*. In this embodiment, inner support beam 231*d* is interior to edge support 230*d*, such that inner support beam 231*d* is flush against edge support 230*d* on two sides. Further, inner support beam 231*d* is of shorter length than 230*d*, such that distal ends of inner support beam 231*d* are in contact with the inner surfaces of top and bottom pallets 210*a* and 210*b*. Edge supports 230*a-d* and their associated inner support beams can be of any height, but are generally of greater height to accommodate larger conveyor belt widths, and lesser height to accommodate smaller conveyor belt widths.

Side beams 235*a-d* extend diagonally across the interior surfaces of edge supports 230*a-d* and/or their corresponding inner supports beams, interconnecting adjacent edge supports and/or inner support beams, and providing additional support to crating system 200. For example, side beam 235*a* extends from a top portion of edge support 230*a* to a bottom portion of edge support 230*b*; side beam 235*b* extends from a top portion of edge support 230*b* to a bottom portion of 230*c*; and so forth. Edge supports 230*a-d* and crossbeams 235*a-d* create four open sides of crating system 200, connecting corresponding edges of top and bottom pallets 210*a* and 210*b*. Side beams 235*a-d* can be of any length, but are generally longer to accommodate larger conveyor belt widths and/or thicker rolls of belt, and shorter to accommodate smaller conveyor belt widths and/or thinner rolls of belt.

A hub assembly, or "spool", located interior to crating system 200, is comprised of axle 240 and drum hubs 250*a* and 250*b*. Axle 240 is cylindrical in shape and can be made of any suitable material, such as, for example, PVC piping, and can be either reusable or disposable. The diameter of axle 240 is less than or equal to that of pallet holes 220*a* and 220*b* and the holes of drum hubs 250*a* and 250*b* (described further herein), such that axle 240 can be inserted into or removed from pallet holes 220*a* and 220*b* and drum hubs

250*a* and 250*b* during assembly or disassembly. Axle 240 is attached to drum hubs 250*a* and 250*b* at distal ends, as is described further herein.

Although shown and described in FIG. 2 with respect to edge supports 230*a-d* and side beams 235*a-d*, any number of other configurations may be used to connect and support top and bottom pallets 210*a* and 210*b*. In one embodiment, side beams 235*a-d* can be provided across the exterior surfaces of edge supports 230*a-d*. Alternatively or additionally, solid wood panels and/or pieces of sheet metal can be used to create closed sides on crating system 200, connecting corresponding edges of top and bottom pallets 210*a* and 210*b*. Other forms of support may also or alternatively be provided, such as, for example, screws drilled through edge supports 230*a-d* and into top and bottom pallets 210*a* and 210*b*. Alternatively, side beams 235*a-d* or other forms of support can be omitted entirely.

Figure 3A:
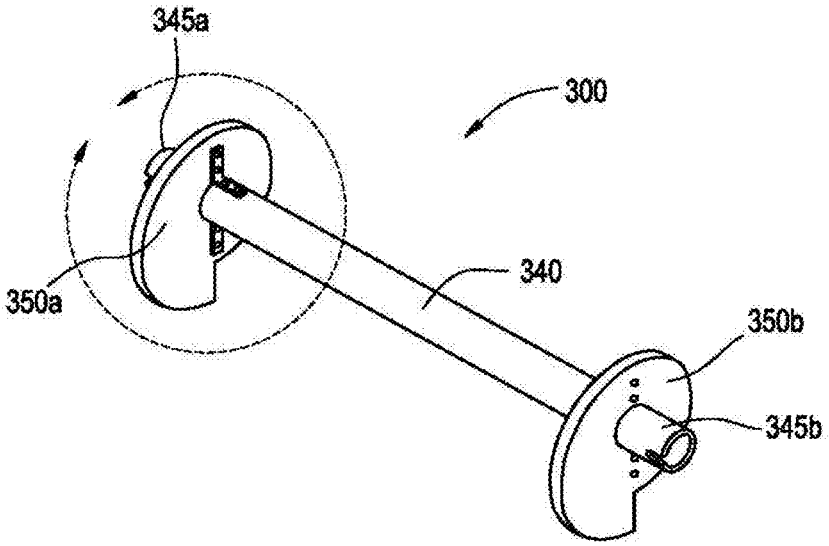
FIG. 3A is a perspective view of a hub assembly for use in a crating system in accordance with an implementation of the present invention.
Figure 3B:
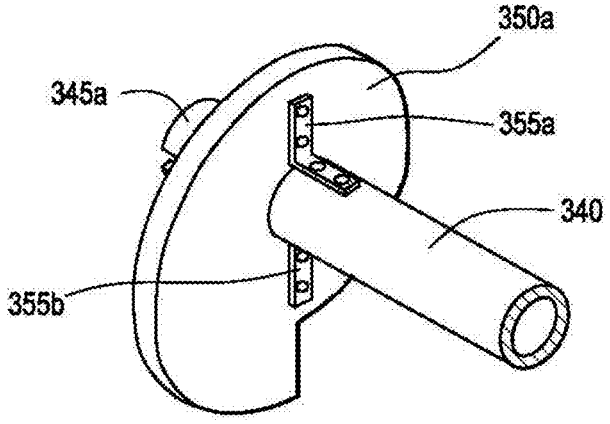
FIG. 3B is a detailed perspective view of a distal end of the hub assembly shown in FIG. 3A.
Figure 3C:
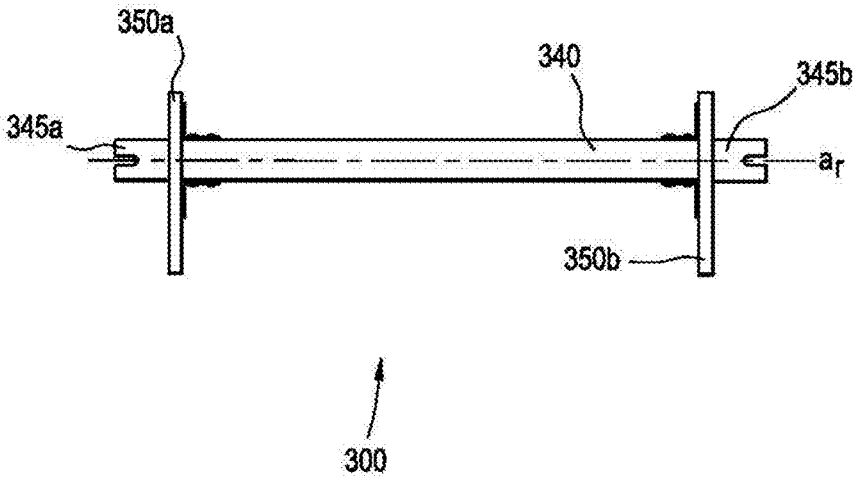
FIG. 3C is a cross-sectional view of the hub assembly shown in FIG. 3A.

FIGS. 3A and 3C are perspective and cross-sectional views of hub assembly 300, respectively, for use in a crating system in accordance with an embodiment of the present invention. Hub assembly 300 is comprised of axle 340 and drum hubs 350*a* and 350*b*. Although illustrated as being entirely cylindrical in shape, axle 340 can be of any shape that allows for rotational movement in a clockwise and/or counter clockwise direction, as indicated by the arrows. For example, axle 340 can be composed primarily of square tubing, with cylindrical tubing welded to distal ends.

Drum hubs 350*a* and 350*b* are attached to distal ends of axle 340, such that opposite portions 345*a* and 345*b* of axle 340 protrude beyond drum hubs 350*a* and 350*b*. This configuration allows opposite portions 345*a* and 345*b* of axle 340 to be slidably inserted into pallet holes, such as pallet holes 220*a* and 220*b* through the inner planks of top and bottom pallets 210*a* and 210*b* of FIG. 2. Drum hubs 350*a* and 350*b* can be made of any sturdy material, such as wood, plastic and/or metal, and can be either reusable or disposable.

In one embodiment, opposite portions 345*a* and 345*b* of axle 340 each have notches cut therein, as shown in FIG. 3A and FIG. 3C. These notches can be used, for example, to engage a manual or automatic component for rolling and/or unrolling a conveyor belt from drum hubs 350*a* and 350*b* about an axis $a_r$. For example, an automatic roller may be used to wind a conveyor belt onto drum hubs 350*a* and 350*b* at the point of manufacture. In this embodiment, a key on the automatic roller can slide into and engage one or both notches of axle 340, so that the automatic roller can apply torque to axle 340, causing rotational movement of axle 340 about an axis $a_r$. Although shown and described with respect to notches, however, any components or combination of components can be used to grip and/or engage and turn axle 340, such as frictional components, magnetic components, mechanical components (such as holes and pins), etc.

FIG. 3B is a detailed perspective view of a distal end of the hub assembly shown in FIGS. 3A and 3C, illustrating the connection between axle 340 and drum hub 350*a* according to one embodiment. In this embodiment, axle 340 is connected to drum hub 350*a* at two points approximately 180° separated using angle bracket assemblies 355*a* and 355*b*, each comprising an angle bracket and screws. Angle bracket assemblies 355*a* and 355*b* function to resist the torque applied by a manual or automatic turning means during loading or unloading, as described further herein, causing rotational movement. Although illustrated and described with respect to angle bracket assemblies 355*a* and 355*b*, axle 340 can be fixed to drum hubs 350*a* and 350*b* according to any method while fulfilling the same purpose, as one skilled in the art would appreciate. For example, axle 340 can alternatively or additionally be fixed to drum hubs 350*a* and 350*b* using glue, a collar, a clamp, etc.

Axle 340 can be a variety of lengths to accommodate conveyor belts of various widths. In general, the length of axle 340 increases with larger conveyor belt widths, and decreases with smaller conveyor belt widths. Similarly, the distance between drum hubs 350*a* and 350*b* can increase for larger conveyor belt widths, and decrease for smaller conveyor belt widths.

Figure 4A:
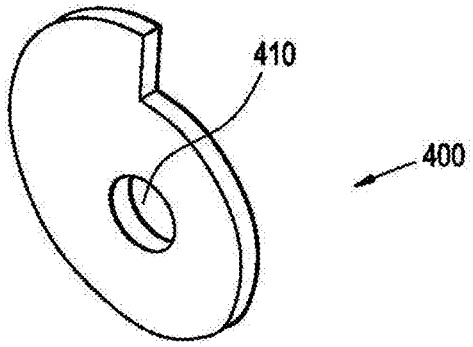
FIG. 4A is a perspective view of a drum hub for use in a crating system in accordance with an implementation of the present invention.
Figure 4B:
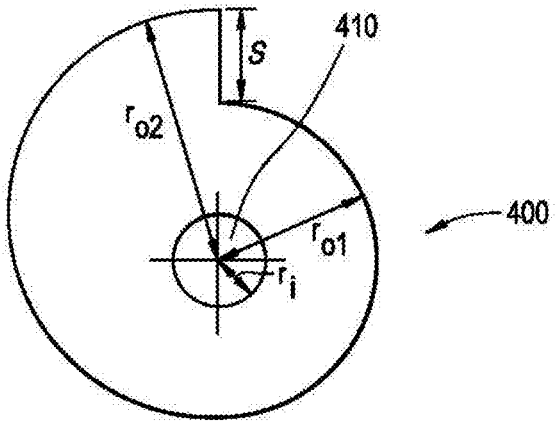
FIG. 4B is a cross-sectional view of the drum hub shown in FIG. 4A.

FIGS. 4A and 4B are perspective and side views, respectively, of drum hub 400 of a hub assembly for use in a crating system. Drum hub 400 has hub hole 410 of constant radius $r_i$. Radius $r_i$ is greater than or equal to the radius of the axle in a full hub assembly, such as axle 240 of FIG. 2, in order that the axle can be slidably inserted into hub hole 410. Although illustrated as being centrally located with respect to outer minimum radius $r_{o1}$ of drum hub 400, hub hole 410 does not need to be at any particular center radius, and may instead be located eccentrically on drum hub 400. The placement of hub hole 410 may be selected so as to allow a conveyor belt wound on the drum hubs of the axle to be centered within the crating system.

Although illustrated as being cylindrical in shape, hub hole 410 can be of any shape configured to accommodate an axle. For example, hub hole 410 may be square shaped in order to accommodate an axle comprising square tubing. In this embodiment, greater traction may be provided for the loading or unloading of conveyor belts, particularly large conveyor belts, due to the increased resistance of applied torque at all four corners of the square. In this embodiment, a fixed connection between the axle and drum hub 400 is optional.

As shown in FIG. 4B, drum hub 400 has outer radii of increasing length between minimum radius $r_{o1}$ and maximum radius $r_{o2}$. After reaching maximum radius $r_{o2}$, the outer radius of drum hub 400 reverts back to minimum radius $r_{o1}$, creating a step s in drum hub 400. In the illustrated embodiment, a full 360° rotation of drum hub 400 begins with a constant minimum radius measurement of $r_{o1}$ for the first 180° of rotation that increases gradually to a maximum radius measurement of $r_{o2}$, then drops back or steps down to a minimum radius measurement of $r_{o1}$ after the complete 360° rotation.

The increase between minimum radius $r_{o1}$ and maximum radius $r_{o2}$ can be gradual, constant, staggered or variable, but is preferably smooth in transition. For example, although illustrated and described with a constant minimum radius $r_{o1}$ for the first 180° of rotation, the outer radii of drum hub 400 may increase throughout the full 360° rotation from minimum radius of $r_{o1}$ to maximum radius $r_{o2}$. In this embodiment, drum hub 400 may appear more spiral in shape than the embodiment shown in FIG. 4B.

Figure 4C:
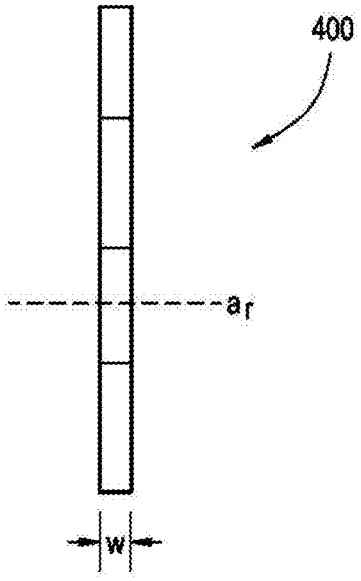
FIG. 4C is a side view of the drum hub shown in FIG. 4A.

As shown in FIG. 4C, which is a cross-sectional view of the drum hub of FIGS. 4A and 4B, drum hub 400 has a constant width w. As one skilled in the art will appreciate, a drum hub may have multiple widths in alternative embodiments, while still performing the same function as drum hub 400 with constant width w. Drum hub 400 is configured to move rotationally about an axis $a_r$, which can be positioned centrally with respect to outer minimum radius $r_{o1}$, as previously described, or can be position eccentrically.

Drum hub 400 can be produced in a variety of sizes to accommodate conveyor belts of various thicknesses. For example, with respect to most conventional conveyor belts, the step s between minimum radius of $r_{o1}$ and maximum radius $r_{o2}$ of drum hub 400 is increased for larger belt thicknesses, or decreased for smaller belt thicknesses. With respect to self-stacking spiral belts, the step s is approximately equal to the height of the belt's side plates, as discussed and shown further herein. In either embodiment, a substantially flush surface is created upon attachment of the belt at step s, filling the gap between minimum radius $r_{o1}$ and maximum radius $r_{o2}$. In still another embodiment, minimum radius $r_{o1}$ is equal to maximum radius $r_{o2}$, eliminating step s entirely.

The outer circumference of drum hub 400 can be increased or decreased to accommodate differing radii of curvature of belts. For example, a belt with a small radius of curvature may allow for a smaller outer circumference of drum hub 400, while a belt with a large radius of curvature may require a larger outer circumference of drum hub 400. Preferably, the outer circumference of drum hub 400 is large enough that the links of a wound belt are prevented from separating. For example, with respect to a wound self-stacking spiral belt, the gaps formed between side plates are preferably narrower than the width of the side plates themselves, as shown, for example, in FIG. 9. Because the width of the gaps increases with increased height of the side plates in this embodiment, a greater radius of curvature, and thus a larger outer circumference of drum hub 400, may be needed to reduce gap size to an acceptable width.

Figure 5A:
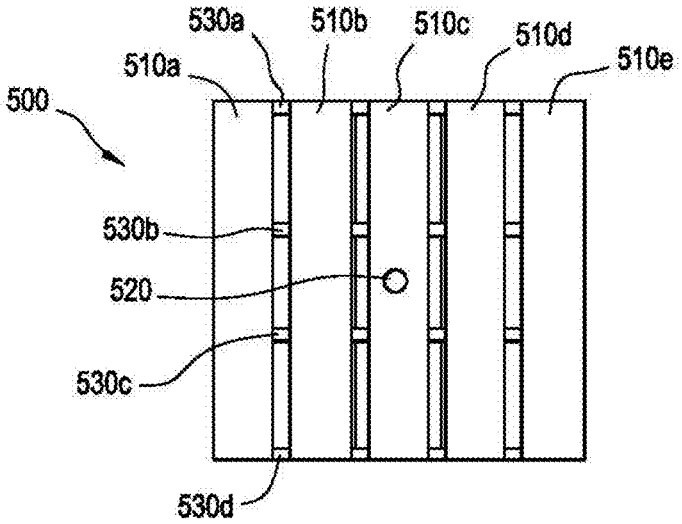
FIG. 5A is an interior view of an end pallet for use in a crating system in accordance with an implementation of the present invention.

FIG. 5A is an interior view of end pallet 500 for use in a crating system in accordance with an embodiment of the present invention. End pallet 500 resembles a conventional shipping pallet, as one with skill in the art would recognize, but can be a pallet of any configuration. End pallet 500 is typically made of wood, and may be made of, for example, heat-treated lumber of various sizes. However, end pallet 500 can be made of any other suitable material, such as, for example, metal and/or plastic. Preferably, end pallet 500 is approved for intra- and international shipment.

End pallet 500 comprises interior planks 510*a-e*, which are positioned interior to the crating system when fully assembled. Although illustrated as being approximately equally spaced, one skilled in the art will recognize that equal spacing of interior planks 510*a-e* is not required to perform the functions of end pallet 500. Preferably, however, one of interior planks 510*a-e* is centrally located to accommodate pallet hole 520. In the illustrated embodiment, pallet hole 520 is cut, drilled or otherwise created in interior plank 510*c*, such that it is positioned centrally both width-wise and length-wise on end pallet 500.

Figure 5B:
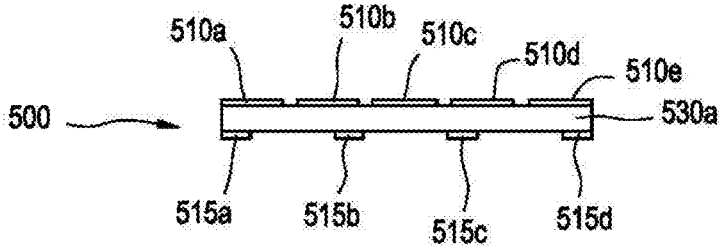
FIG. 5B is a side view of the end pallet shown in FIG. 5A.

FIG. 5B is a side view of end pallet 500, which can be seen, for example, from a side parallel to interior planks 510*a-e* and exterior planks 515*a-d*, which are themselves parallel to each other. Exterior planks 515*a-d* are positioned exterior to the crating system when fully assembled. Although illustrated as being approximately equally spaced, one skilled in the art will recognize that equal spacing of exterior planks 515*a-d* is also not required to perform the functions of end pallet 500. However, exterior planks 515*a-d* are preferably positioned on end pallet 500 so as to provide access to pallet hole 520 of interior plank 510*c*.

Each of interior planks 510*a-e* and exterior planks 515*a-d* are of approximately the same length. Further, the combined width of interior planks 510*a-e* including the spacing therebetween, is approximately equal to the combined width of exterior planks 515*a-d* including its respective spacing. Interior planks 510*a-e* and exterior planks 515*a-d* are attached perpendicularly across the width of cross planks 530*a-d*, such that little or no overhang exists on any side of end pallet 500. In other words, the length of each of cross planks 530*a-d* is preferably less than or equal to one of the aforementioned combined widths.

Although illustrated and described with a particular number of interior planks 510*a-e*, exterior planks 515*a-d*, and cross planks 530*a-d*, the number of planks used in any of these positions may vary. Further, although shown as approximately equal in length such that a square configuration is viewed from the angle shown in FIG. 5A, interior planks 510*a-e* and exterior planks 515*a-d* may alternatively have lengths less than or greater than the lengths of cross planks 530*a-d*, such that a rectangular configuration would instead be viewed from the angle shown in FIG. 5A.

Figure 5C:
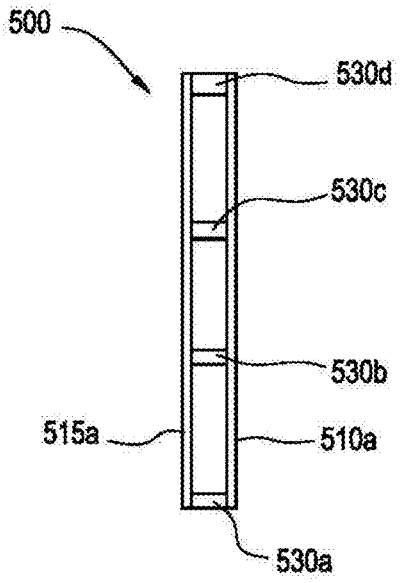
FIG. 5C is a different side view of the end pallet shown in FIG. 5A.

FIG. 5C is a different side of end pallet 500, from a perspective parallel to cross planks 530*a-d*. Cross planks 530*a-d* are positioned between and perpendicular to interior planks 510*a-e* and exterior planks 515*a-d*, as discussed above. Cross planks 530*a-d* are preferably positioned such that the spaces between them are able to accommodate the tines of a fork truck or other lifting machine or device. Further, cross planks 530*a-d* are of a length such that such that little or no overhang exists on any side of end pallet 500, as described above.

End pallet 500 as described may be used for both the top and bottom pallets in a crating system of the invention, such that the vertical positioning of the crating system is irrelevant. Alternatively, end pallet 500 may be used for only the bottom pallet, in order to provide easy handling with a fork truck. In this embodiment, the top pallet may be of a design configured to receive exterior planks 515*a-d* in channels, so as to allow the crates to be stacked sturdily.

Figure 6:
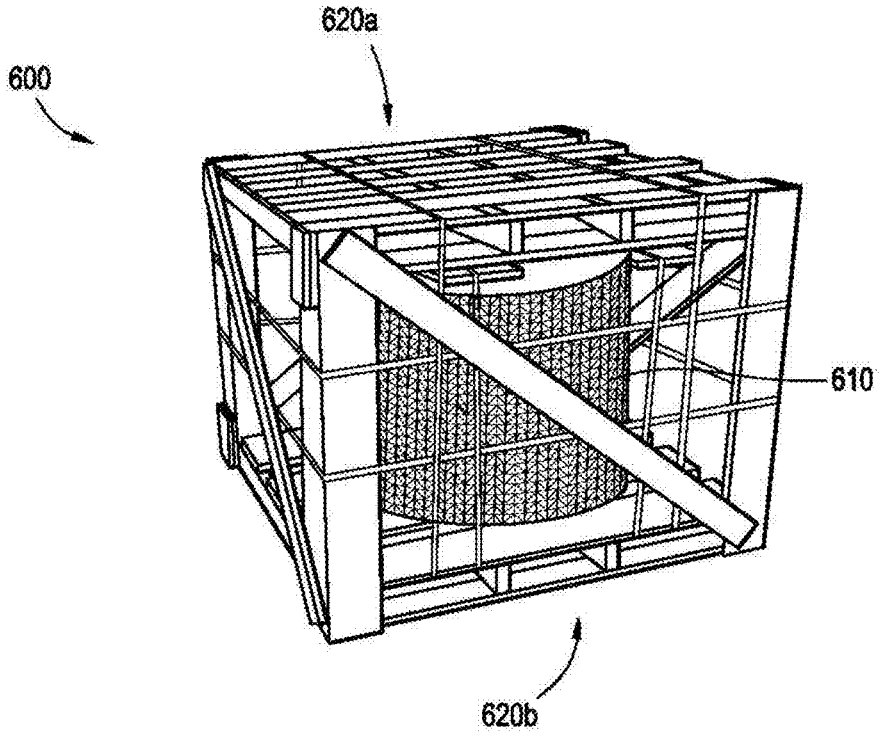
FIG. 6 is a perspective view of a storing and transporting configuration of a crating system in accordance with one implementation of the present invention.

FIG. 6 is a perspective view of crating system 600 in accordance with one implementation of the present invention. In this embodiment, crating system 600 is in a configuration suitable for storing and transporting belt roll 610. Thus, crating system 600 may have a standard shape that is easily loaded into a box trailer and maneuvered to the point of installation. For example, crating system 600 may be a 4'×4'×4' cube for transportation in an 8' trailer.

Belt roll 610 can be any rolled material, but is preferably a conveyor belt. Belt roll 610 can be a new or replacement conveyor belt for a customer, or an old, worn, damaged or defective conveyor belt being returned to a manufacturer. Further, belt roll 610 can be a self-stacking spiral conveyor belt, as described herein, or any other type of conveyor belt. A single continuous section of conveyor belt can be wound into belt roll 610, which is wrapped on drum hubs attached to an axle, as previously described.

In this configuration, belt roll 610 is positioned on its side, such that the axle is perpendicular to end pallets 620*a* and 620*b*. Thus, in this embodiment, the width of crating system 600 is preferably equal to or slightly larger than the thickness of belt roll 610 across its multiple wound layers. The perpendicular position of belt roll 610 reduces rotational movement during transportation of crating system 600, and relieves stress on the hub assembly caused by the weight of belt roll 610.

Figure 7:
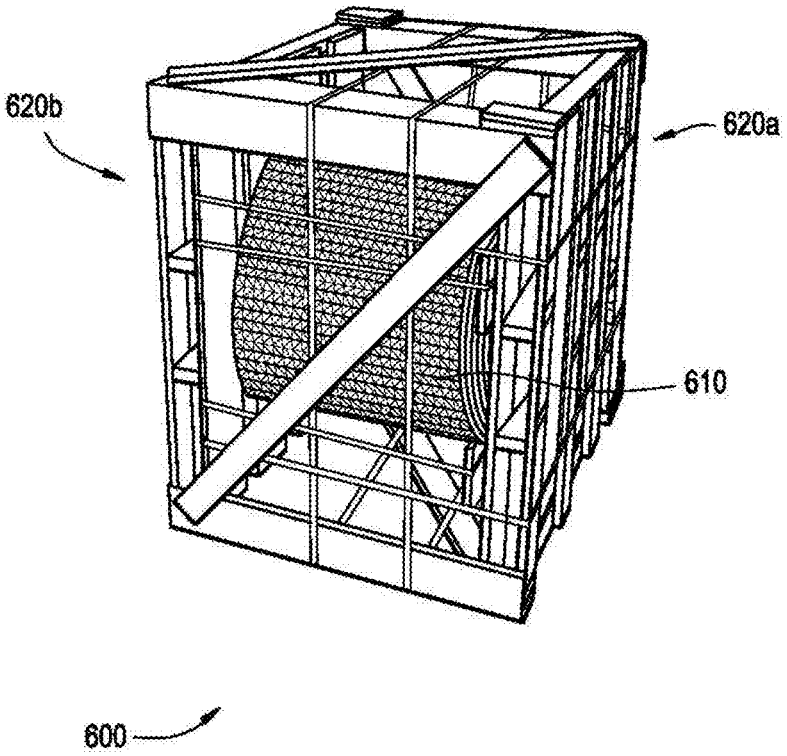
FIG. 7 is a perspective view of a pre-loading and/or pre-unloading configuration of a crating system in accordance with one implementation of the present invention.

Crating system 600 may optionally have strapping wrapped around its sides and top and bottom pallets 620*a* and 620*b* to provide additional support during transportation, as shown in FIGS. 6 and 7. In another embodiment, crating system 600 can be wrapped in plastic or other materials (not shown) to protect it from hazardous weather or environmental conditions.

FIG. 7 is a perspective view of crating system 600 which has been tipped or otherwise rotated onto a side (consisting of a side beam as described above, for example). This configuration is used after loading belt roll 610, or prior to unloading belt roll 610. Preferably, the space between end pallets 620*a* and 620*b* and their adjacent drum hubs is minimized, such that belt roll 610 does not substantially shift within crating system 600 when tipped or rotated. Belt roll 610 remains wrapped around the drum hubs, and the axle remains perpendicular to end pallets 620*a* and 620*b*. With the axle positioned horizontally, belt roll 610 allows belt roll 610 can move rotationally on or off of the drum hubs for easy loading or unloading of belt roll 610.

Figure 8:
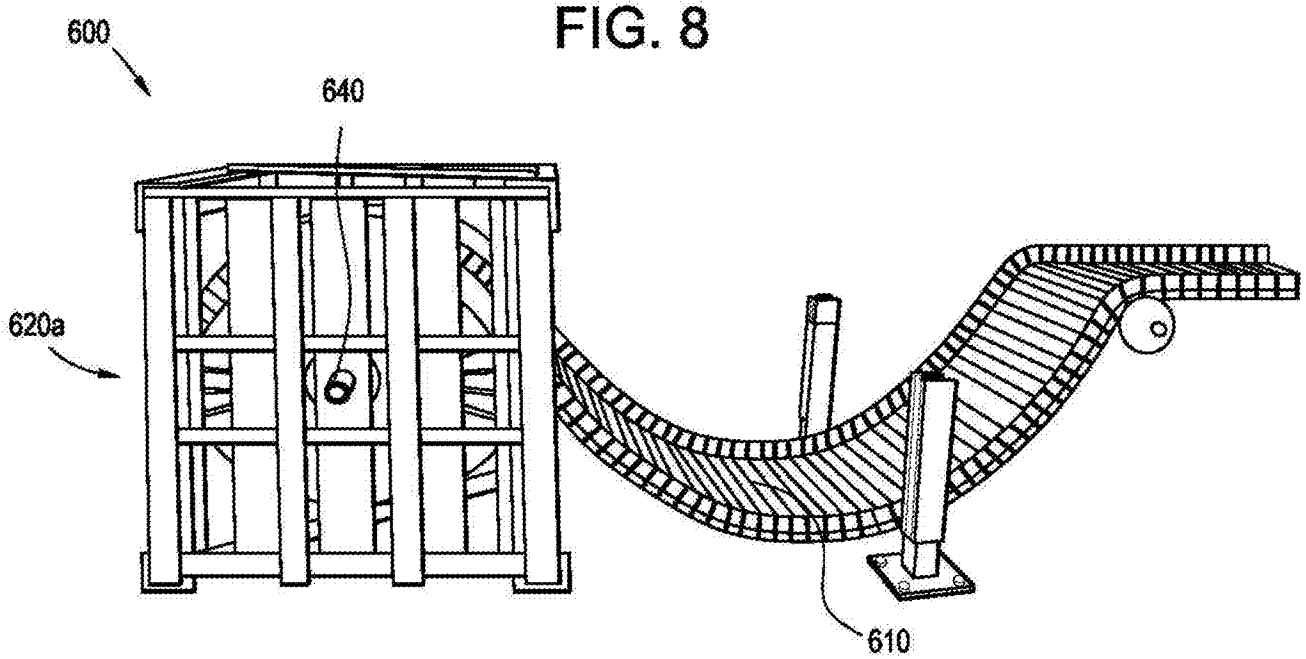
FIG. 8 is a perspective view of a configuration of a crating system during loading and/or unloading in accordance with one implementation of the present invention.

FIG. 8 is another perspective view of crating system 600 tipped on its side, but with an adjacent side removed to load or unload belt roll 610. A side of crating system 600 adjacent to the side onto which it was tipped is removed, either in part or in its entirety. All other sides may remain intact, lessening unloading time. Belt roll 610 is then unwound for delivery to its destination through the removed portion of crating system 600. Alternatively or additionally, a side of crating system 600 opposite to the side onto which it was tipped can be removed to facilitate loading or unloading from, for example, a location above crating system 600.

Belt roll 610 may be unwound manually from crating system 600, or may be unwound using a motor or other mechanical device. In one embodiment, a crank handle can be attached to axle 640 to manually feed belt roll 610 off of the drum hubs and out of crating system 600. The crank handle can be configured to engage notches in axle 640 in order to provide greater traction to a user unwinding belt roll 610, as described previously.

Belt roll 610 may also be unwound and self-dispensed using an existing conveyor belt system at the destination. For example, a customer at the destination can hold the distal end of belt roll 610, unwinding belt roll 610 from the drum hubs until it is of sufficient unwound length to connect it to a tail end of an existing belt to be replaced. After connection is made between belt roll 610 and the existing belt using welded splice joints or any other means, the existing conveyor belt system can be switched on, unwinding belt roll 610.

Belt roll 610 unwinds rotationally from the drum hubs on axle 640. Axle 640 protrudes beyond the drum hubs and through the pallet holes in end pallets 620*a* and 620*b*. Distal ends of axle 640 preferably fall between the interior planks and the exterior planks of end pallets 620*a* and 620*b*. Thus, axle 640 remains intact within the various pallet holes throughout movement of axle 640 and crating system 600, without protruding beyond the exterior planks The pallet holes, along with their respective end pallets 620*a* and 620*b*, act as bearing and support surfaces for axle 640, allowing belt roll 610 to turn freely about its axis.

In one embodiment, an opposite tail end of the existing belt that is not attached to belt roll 610 can be placed onto and attached to the drum hubs of an empty crating system without belt roll 610 therein (not shown), such that the existing belt may be wound and self-loaded using the same existing conveyor belt system. In other words, when the existing conveyor belt system is switched on, the existing belt can be wound onto the drum hubs of the crating system, while belt roll 610 is simultaneously being unwound from crating system 600. Thus, packing and disposal time of the existing belt being replaced at the destination is reduced, and eliminates the need for additional supplies to perform such a function.

Once the first belt roll 610 is unwound, another crating system 600 can be moved into place, its corresponding belt roll 610 attached using welded splice joints or other means to a tail end of the previous unwound belt. This process can be repeated with multiple crating systems, until the desired portions of the existing belt are replaced. In the case of full replacement, the old belt is cut where it was welded to the first belt roll 610, and a welded splice joint or other connection means is used to attach the loose end of the first belt roll to the loose end of the final belt roll. Preferably, each belt roll comprises one continuous section of belt, reducing the number of welded splice joints needed to reassemble the belt at the destination.

In the embodiment where the existing belt is wound back into the unused or empty crating systems, the belt is cut after the crating system reaches its maximum loading capacity. Then, another unused or empty crating system, such as one that has been recently unloaded, can be moved into place, and the loose end of the existing belt still attached to the existing conveyor belt system can be placed onto the drum hubs of the next crating system, and the existing conveyor belt system can be switched on to resume loading. This process can be repeated until the desired portions of the old belt are fully loaded into one or more crating systems. The crating systems can then be disposed of, reused, returned to the manufacturer with or without the old belt loaded therein, recycled, or hauled away to be broken down and sold.

Figure 9:
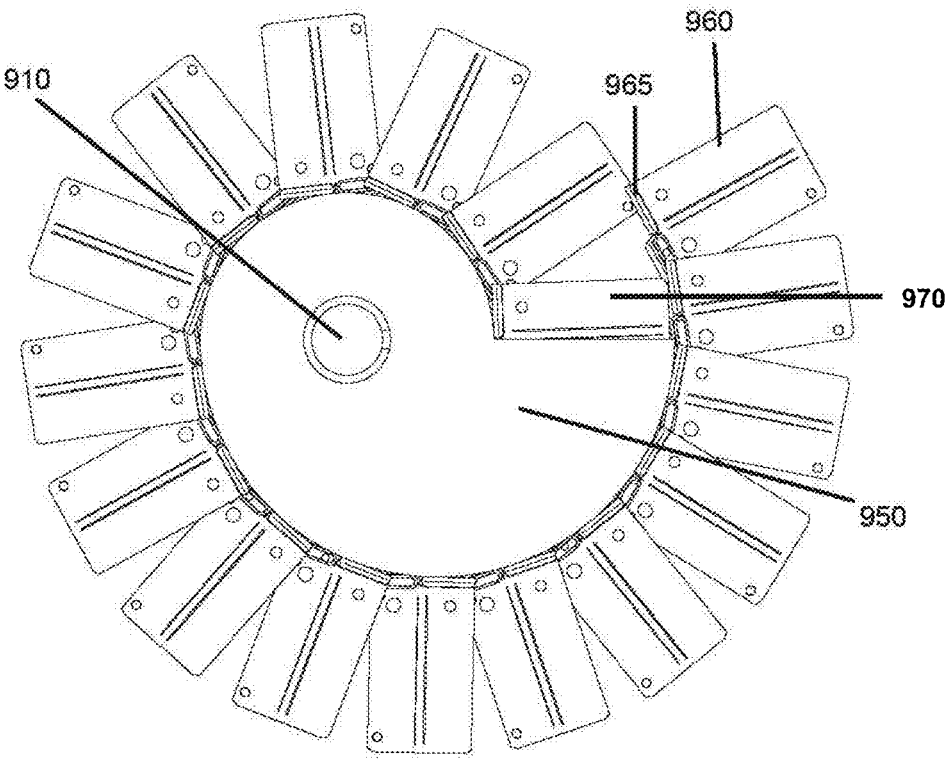
FIG. 9 is an end view of a drum hub with a self-stacking spiral belt wound thereon in accordance with an implementation of the present invention.

FIG. 9 is an end view of drum hub 950 with a self-stacking spiral belt comprising a plurality of end plates, such as that indicated by reference numeral 960, wound thereon. Drum hub 950 is attached to axle 910, which has been fitted into a hub hole in drum hub 950. As one skilled in the art will appreciate, a second drum hub (not shown) is also positioned on axle 910 parallel to drum hub 950 at a distance approximately equal to the width of the self-stacking spiral belt. The second drum hub has wrapped thereon an opposite distal edge of the self-stacking spiral belt, including a second plurality of end plate, such that a belt roll, such as that indicated by reference numeral 610 in FIG. 6 or 7, is created. With respect to FIG. 9, however, only a single drum hub 950 upon which a single distal edge of the self-stacking spiral belt is wrapped will be shown and described.

In this embodiment, a first end plate 970, having a thickness approximately equal to the length of the step, is attached to the step in drum hub 950, filling the gap between the minimum and maximum radii of drum hub 950. The belt is then loaded onto drum hub 950, either manually or automatically, as described above. Thus, a second and subsequent layers of belt and their corresponding side plates, such as side plate 960, are elevated above the first layer of belt, allowing for a smooth transition during loading and unloading. Without the lowering of the first layer of belt and/or the elevation of the second layer of belt via the step in drum hub 950, a substantial "bump" would be created in the belt roll due to the space created between the drum hub radius and the thickness of end plate 970. Thus, the step in drum hub 950 allows for smooth transition between subsequent layers of belt, and prevents damage to both the belt itself and its side plates.

In the self-stacking spiral conveyor belt shown in FIG. 9, the plurality of sides plates each have edges, such as edge 965 on side plate 960. These edges contain notches that engage the side plates in the previous layer of belt. For example, edge 965 of side plate 960 in the second layer of belt may have a notch that engages side plate 970 in the first layer of the belt. Thus, the plurality of side plates are interconnected when wound, preventing misalignment during loading and unloading. Further, the interconnection of side plates secures the belt's position between opposite drum hubs and minimizes movement within the crating system, which in turn prevents damage to the belt.

Figure 10:
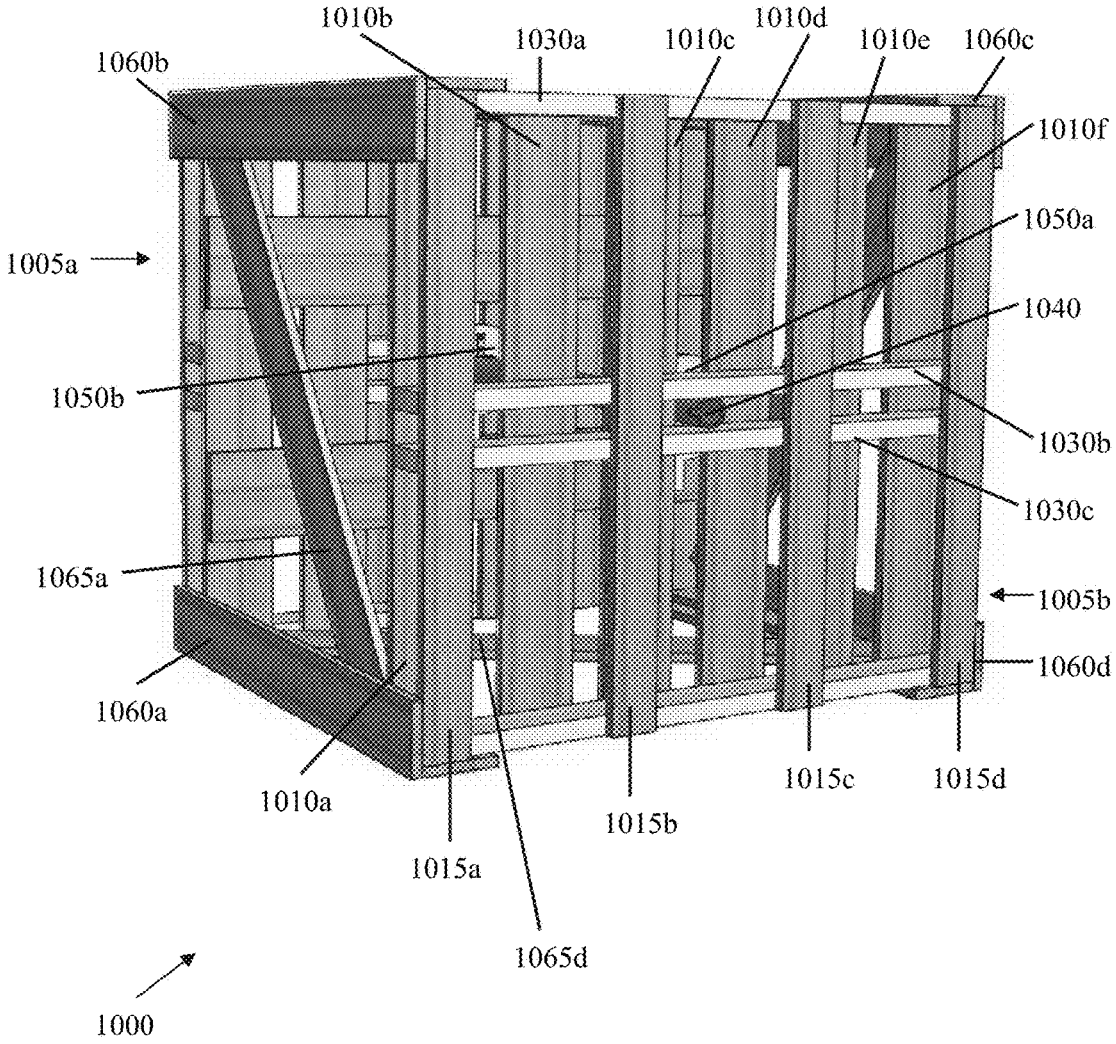
FIG. 10 is a perspective view of an assembled crating system for storing, transporting and dispensing conveyor belts in accordance with another implementation of the present invention.

FIG. 10 is a perspective view of an assembled crating system 1000 for storing, transporting and dispensing conveyor belts in accordance with another embodiment of the present invention. In this embodiment, a pallet hole is created in channels between planks of top and bottom pallets 1005*a* and 1005*b* to engage axle 1040. As shown, bottom pallet 1005*b* has interior planks 1010*a-f*, exterior planks 1015*a-d*, and cross planks 130*a-d*, which are positioned so as to allow axle 1040 to extend perpendicularly through and beyond interior planks 1010*a-f*, and to engage cross planks 1030*b* and 1030*c*. Preferably, axle 1040 does not extend beyond exterior planks 1015*a-d*, so that a flush outer surface is maintained on bottom pallet 1005*b*. Top pallet 1005*a* may be similarly configured to bottom pallet 1005*b*, or may be alternately configured, as described further herein.

A pallet hole is created in overlapping channels between interior planks 1010*c* and 1010*d*, such that is can engage axle 1040. The diameter of axle 1040 is preferably slightly smaller than the spacing between interior planks 1010*c* and 1010*d*, and the spacing between cross planks 1030*c* and 1030*d*. Thus, axle 1040 is able to rotate freely within the pallet hole, without shifting significantly between interior planks 1010*c* and 1010*d* and cross planks 1030*c* and 1030*d*. In one embodiment, a lubricant or other topical treatment may be applied to the surface of axle 1040 and/or to an interior surface of the pallet hole, to further promote free rotational movement of axle 1040.

As shown and described with respect to previous embodiments, crating system 1000 has edge supports 1060*a-d* and side beams 1065*a*, 1065*c*, and 1065*d* (a fourth side beam that may exist in this configuration is not shown). Further, axle 1040 is attached to drum hubs 1050*a* and 1050*b* between top and bottom pallets 1005*a* and 1005*b*. A conveyor belt (not shown) can be wrapped about drum hubs 1050*a* and 1050*b*. Drum hubs 1050*a* and 1050*b* can have a step therein upon which the first layer of belt can be wrapped, as described above, to allow for a smooth transition between subsequent layers of belt.

FIG. 11A is an interior view of end pallet 1100 for use in a crating system, such as that described in FIG. 10, for example, in accordance with an embodiment of the present invention. End pallet 1100 resembles a conventional shipping pallet, as one with skill in the art would recognize, but can be a pallet of any configuration. End pallet 1100 is typically made of wood, and may be made of, for example, heat-treated lumber of various sizes. However, end pallet 1100 can be made of any other suitable material, such as, for example, metal and/or plastic. Preferably, end pallet 1100 is approved for intra- and international shipment.

End pallet 1100 comprises interior planks 1110*a-f*, which are positioned interior to the crating system when fully assembled. Although illustrated as being approximately equally spaced, one skilled in the art will recognize that equal spacing of interior planks 1110*a-f* is not required to perform the functions of end pallet 1100. Preferably, however, none of interior planks 1110*a-f* are centrally located, so that a channel is created between interior planks 1110*c* and 1110*d*. As discussed with respect to FIG. 10, the channel created between interior planks 1110*c* and 1110*d* preferably has a width slightly larger than the diameter of an axle.

FIG. 11B is a side view of end pallet 1100, which can be seen, for example, from a side parallel to interior planks 1110*a-f* and exterior planks 1115*a-d*, which are themselves parallel to each other. Exterior planks 1115*a-d* are positioned exterior to the crating system when fully assembled. Although illustrated as being approximately equally spaced, one skilled in the art will recognize that equal spacing of exterior planks 1115*a-d* is also not required to perform the functions of end pallet 1100.

Each of interior planks 1110*a-f* and exterior planks 1115*a-d* are of approximately the same length. Further, the combined width of interior planks 1110*a-f* including the spacing therebetween, is approximately equal to the combined width of exterior planks 1115*a-d* including its respective spacing. Interior planks 1110*a-f* and exterior planks 1115*a-d* are attached perpendicularly across the width of cross planks 1130*a-d*, such that little or no overhang exists on any side of end pallet 1100. In other words, the length of each of cross planks 1130*a-d* is preferably less than or equal to one of the aforementioned combined widths.

Further, cross planks 1130*b* and 1130*c* are preferably spaced so as to create a channel between them of a width slightly greater than the diameter of an axle. Thus, an axle may be inserted into pallet hole 1120, created by the overlap of the channel between interior planks 1110*c* and 1110*d* and the channel between cross planks 1130*b* and 1130*c*. Thus, an axle inserted in pallet hole 1120 is surrounded by interior planks 1110*c* and 1110*d* and cross planks 1130*b* and 1130*c*.

Although illustrated and described with a particular number of interior planks 1110*a-f*, exterior planks 1115*a-d*, and cross planks 1130*a-d*, the number of planks used in any of these positions may vary. Further, although shown as approximately equal in length such that a square configuration is viewed from the angle shown in FIG. 11A, interior planks 1110*a-f* and exterior planks 1115*a-d* may alternatively have lengths less than or greater than the lengths of cross planks 1130*a-d*, such that a rectangular configuration would instead be viewed from the angle shown in FIG. 11A.

Figure 11C:
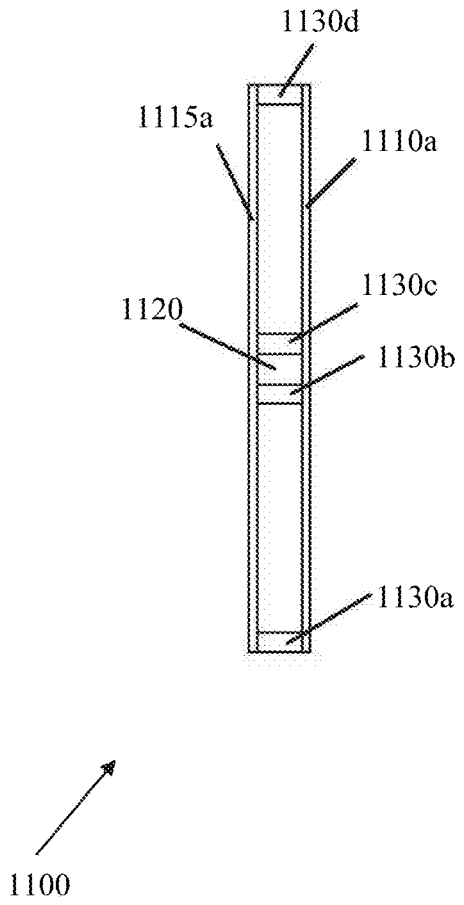
FIG. 11C is a different side view of the end pallet shown in FIG. 11A.

FIG. 11C is a different side of end pallet 1100, from a perspective parallel to cross planks 1130*a-d*. Cross planks 1130*a-d* are positioned between and perpendicular to interior planks 1110*a-f* and exterior planks 1115*a-d*, as discussed above. Cross planks 1130*a-d* are preferably positioned such that the spaces between them are able to accommodate the tines of a fork truck or other lifting machine or device and/or an axle. Further, cross planks 1130*a-d* are of a length such that such that little or no overhang exists on any side of end pallet 1100, as described above.

End pallet 1100 as described may be used for both the top and bottom pallets in a crating system of the invention, such that the vertical positioning of the crating system is irrelevant. Alternatively, end pallet 1100 may be used for only the bottom pallet, in order to provide easy handling with a fork truck. In this embodiment, the top pallet may be of a design configured to receive exterior planks 1115*a-d* in channels, so as to allow the crates to be stacked sturdily.

Figure 12:
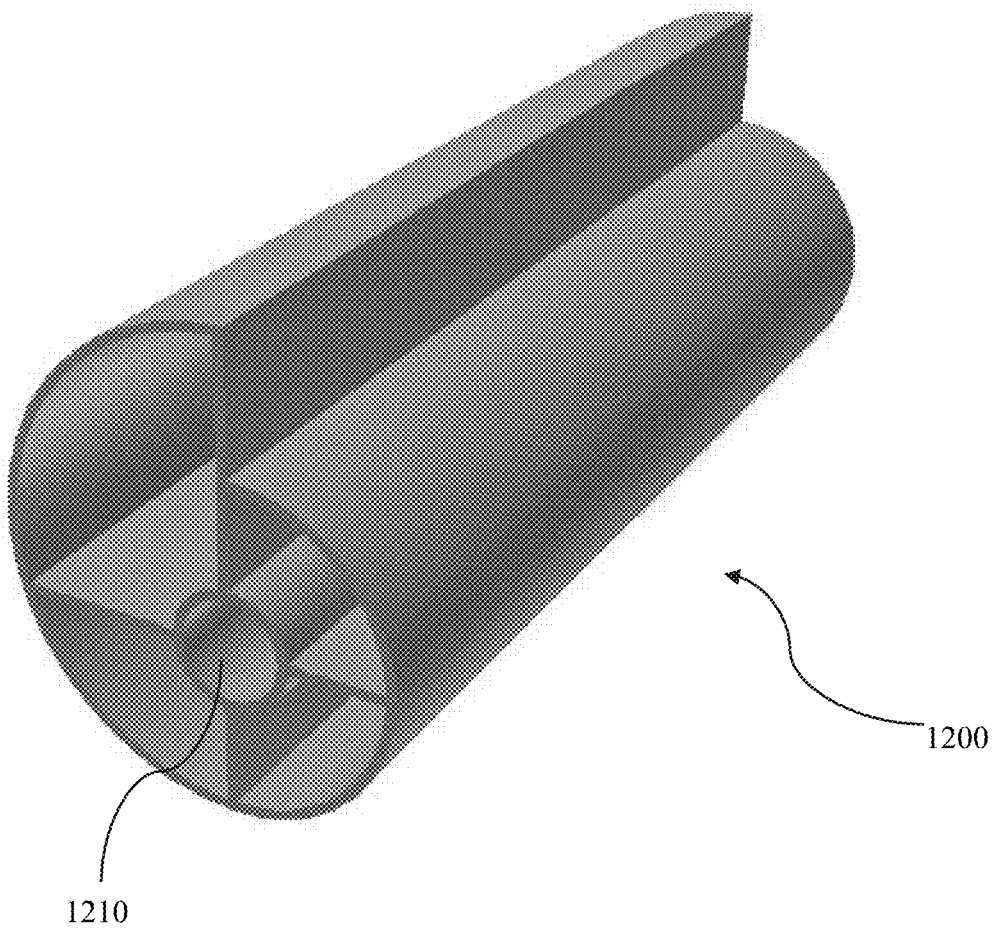
FIG. 12 is a perspective view of a hub of a hub assembly in accordance with an implementation of the present invention.

FIG. 12 is a perspective view of a single hub 1200 of a hub assembly for storing and transporting rolled material in accordance with an implementation of the present invention. Hub 1200 has hub hole 1210. Hub hole 1210 has a radius greater than or equal to the radius of an axle in a full hub assembly, such as axle 240 of FIG. 2, in order that the axle can be slidably inserted into hub hole 1210. Hub 1200 has outer minimum and maximum radii as described herein with respect to FIG. 4B.

As shown in FIG. 12, hub 1200 is formed from an extruded material, such as plastic or metal. It is contemplated, however, that hub 1200 may be formed from any suitable material, and may be hollow (as shown) or solid.

Figure 13:
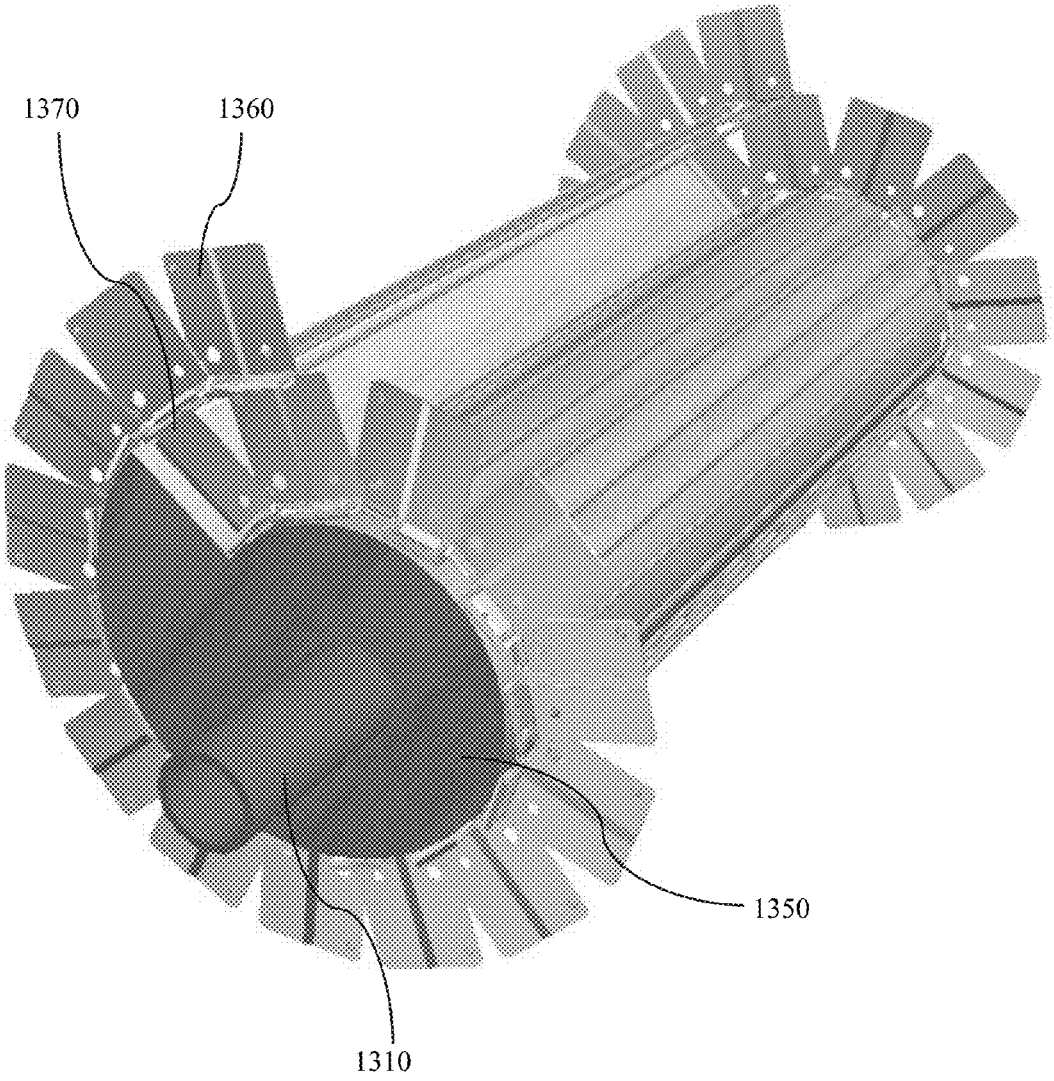
FIG. 13 is an end perspective view of a hub with a self-stacking spiral belt wound thereon in accordance with an implementation of the present invention.

FIG. 13 is an end perspective view of a single hub 1350 with a self-stacking spiral belt comprising a plurality of end plates, such as that indicated by reference numeral 1360, wound thereon in accordance with an implementation of the present invention. Hub 1350 is attached to axle 1310, which has been fitted into a hub hole in hub 1350. In this embodiment, hub 1350 extends across the width of the conveyor belt; thus, a second hub is not necessary.

In this embodiment, a first end plate 1370, having a thickness approximately equal to the length of the step, is abutted against the step in hub 1350, filling the gap between the minimum and maximum radii of hub 1350. The belt is then loaded onto hub 1350, either manually or automatically, as described above. Thus, a second and subsequent layers of belt and their corresponding end plates, such as end plate 1360, are elevated above the first layer of belt, allowing for a smooth transition during loading and unloading.

As shown in FIG. 13, hub 1350 is formed from solid wood. It is contemplated, however, that hub 1350 may be formed from any suitable material, and may be hollow or solid (as shown). For example, hub 1350 may be formed of an extruded material, such as is shown and described with respect to FIG. 12.

The present invention has been described in relation to particular examples, which are intended in all respects to be illustrative rather than restrictive. Those skilled in the art will appreciate that many different combinations of materials and components will be suitable for practicing the present invention.

Other implementations of the invention will be apparent to those skilled in the art from consideration of the specification and practice of the invention disclosed herein. Various aspects and/or components of the described embodiments may be used singly or in any combination. It is intended that the specification and examples be considered as exemplary only, with a true scope and spirit of the invention being indicated by the following claims.

What is claimed is:

1. A hub assembly for storing and transporting rolled material, the hub assembly comprising:

an axle; and a first hub and a second hub attached to said axle, the rolled material being wound on the first hub and the second hub, wherein a perimeter of said first hub and a perimeter of said second hub comprise minimum and maximum radii and a step between the minimum and maximum radii, and wherein a width of the first hub is less than a width of the rolled material, and a width of the second hub is less than the width of the rolled material, and wherein a length of the step is equal to a thickness of the rolled material.

2. The hub assembly of claim 1, wherein the first hub and the second hub are positioned at opposite edges of the rolled material, and wherein the step of the first hub and the step of the second hub are aligned.

3. The hub assembly of claim 1, wherein the rolled material comprises a conveyor belt.

4. The hub assembly of claim 3, wherein the conveyor belt comprises end plates.

5. The hub assembly of claim 4, wherein a length of the step is equal to a thickness of the end plates.

6. The hub assembly of claim 1, wherein the perimeters are defined by a spiral shape formed by gradually increasing radii of the first hub and the second hub throughout one revolution about a common center portion, and wherein a length of the step is equal to a difference between the maximum and minimum radii.

7. The hub assembly of claim 1, wherein the perimeters comprise a first smaller radius with a first center point and at least one successively larger radius with a center point distinct from the first center point, and wherein each successive radius is tangential to the previous radius throughout one revolution, such that the step is created between a beginning of the first smaller radius and an end of a final larger radius.

8. The hub assembly of claim 1, wherein the second hub is spaced apart from the first hub along the axle.

9. The hub assembly of claim 1, wherein the first hub includes a first hub hole, and the axle extends through the first hub hole.

10. The hub assembly of claim 1, wherein the first hub is substantially hollow.

11. The hub assembly of claim 10, wherein the first hub includes a plurality of spokes.

12. The hub assembly of claim 1, wherein each end of the axle includes a notch, and the first hub is attached to the axle by at least one angle bracket assembly.

13. A hub assembly for storing and transporting rolled material, the hub assembly comprising:

an axle; and a first hub and a second hub attached to said axle, wherein a perimeter of said first hub and a perimeter of said second hub comprise minimum and maximum radii and a step between the minimum and maximum radii, wherein a width of the first hub is less than a width of the rolled material, and a width of the second hub is less than the width of the rolled material, and wherein the rolled material comprises a conveyor belt comprising end plates.

14. The hub assembly of claim 13, wherein the first hub and the second hub are positioned at opposite edges of the rolled material, and wherein the step of the first hub and the step of the second hub are aligned.

15. The hub assembly of claim 13, wherein a length of the step is equal to a thickness of the end plates.

16. The hub assembly of claim 13, wherein the first hub includes a first hub hole, and the axle extends through the first hub hole.

17. The hub assembly of claim 13, wherein the first hub is substantially hollow.

18. The hub assembly of claim 17, wherein the first hub includes a plurality of spokes.

19. The hub assembly of claim 13, wherein each end of the axle includes a notch, and the first hub is attached to the axle by at least one angle bracket assembly.

20. The hub assembly of claim 13, wherein the perimeters are defined by a spiral shape formed by gradually increasing radii of the first hub and the second hub throughout one revolution about a common center portion, and wherein a length of the step is equal to a difference between the maximum and minimum radii.

* * * * *